US005103901A

United States Patent [19]

Greenlee

[11] Patent Number: 5,103,901

[45] Date of Patent: Apr. 14, 1992

[54] HYDRAULICALLY OPERATED WELL PACKER

[75] Inventor: Donald R. Greenlee, Cedar Hill, Tex.

[73] Assignee: Dresser Industries, Inc, Dallas, Tex.

[21] Appl. No.: 597,361

[22] Filed: Oct. 12, 1990

[51] Int. Cl.[5] ..... E21B 23/04; E21B 33/128

[52] U.S. Cl. ..... 166/120

[58] Field of Search ..... 166/382, 387, 120, 122, 166/134, 212

[56] References Cited

U.S. PATENT DOCUMENTS

| | | | |
|---|---|---|---|
| 3,002,561 | 10/1961 | Baker et al. | 166/120 |
| 3,054,450 | 9/1962 | Baker | 166/120 |
| 3,142,338 | 7/1964 | Brown | 166/120 |
| 3,195,642 | 7/1965 | Conrad | 166/120 |
| 3,716,101 | 2/1973 | McGowen, Jr. et al. | 166/120 |
| 4,289,200 | 9/1981 | Fisher, Jr. | 166/120 |
| 4,345,649 | 8/1982 | Baugh et al. | 166/120 |
| 4,487,258 | 12/1984 | Jackson et al. | 166/120 |
| 4,754,814 | 7/1988 | Jordan, Jr. | 166/120 |
| 4,834,175 | 5/1989 | Ross et al. | 166/120 |

OTHER PUBLICATIONS

Baker Packers 1982-1983 Catalog, p. 852.

Minimum Exposure Packer, Part No. 118-S-0109, Dated Nov. 3, 1986.

*Primary Examiner*—Thuy M. Bui

*Attorney, Agent, or Firm*—Jones, Day, Reavis & Pogue

[57] ABSTRACT

A hydraulic well packer having upper and lower slip assemblies with pivotable teeth therein for engaging the well casing to lock the packer in the casing and having elastomer seals between the upper and lower slip assemblies. A hydraulic assembly is coupled to the lower slip assembly for forcing it upwardly towards the upper slip assembly thereby compressing the elastomer seals outwardly against the well casing to form a liquid-tight seal and forcing the slip teeth outwardly to lock the well packer in place in the well casing.

7 Claims, 2 Drawing Sheets

HYDRAULICALLY OPERATED WELL PACKER

FIELD OF THE INVENTION

The present invention relates to well packers in general and in particular to an improved hydraulic well packer that allows the well packer to be set hydraulically in the well casing without moving the mandrel or the drill string.

BACKGROUND OF THE INVENTION

It is well known in the petroleum industry that after a bore hole has been completed, there are occasions when corrosive fluids in the bore hole must be kept out of contact with the well pipe casing because of the rapid destruction of the well pipe casing and the inability to replace the casing either practically or economically. In order to protect that portion of the well casing that is immersed in such fluids, well packers have been developed which are lowered down the well casing to a given point and then set in the casing so as to cause a fluid seal in the casing, sealing off that portion of the corrosive fluid below the packer from the well casing above the packer. Since the drill string extends through the packer to the portion of the well fluid below the packer, fluids below the packer can be pumped through the drill string to the surface, thus protecting the well casing above the packer from the corrosive fluids.

Well packers are associated with a cylindrical mandrel attached to the lower end of the drill string. The mandrel in the prior art is inserted through the hollow well packer and has formed on each side thereof a J-shaped slot which engages a gudgeon pin in the surrounding anchor cage that forms a part of the well packer. The anchor cage also has spring loaded friction pads spaced around the outside thereof, generally 90 apart, which engage the inside of the well casing and temporarily hold the well packer in a fixed position with respect to the well casing. The friction pads can support 200–300 pounds of weight without sliding. A gudgeon pin attached to and extending through opposite sides of the anchor cage engages a corresponding one of the J-slots. When the gudgeon pin is in the bottom portion of the J-slot, it is trapped and, by forcing the drill string downward, the packer is forced down into the well casing sliding the friction pads along the inside surface thereof.

When the proper depth at which the packer is to be set is reached in the bore hole, the friction pads hold the packer while the drill string is lifted slightly which releases each gudgeon pin from its trapped position at the bottom of the J-slots. By rotating the drill string slightly, the gudgeon pin is moved into the vertical section of the J-slot. The drill string can then be let down and the gudgeon pin travels upwardly in the J-slot. Forming a part of the mandrel, on the external surface thereof, is a band of threads or teeth. In like manner, on the anchor cage which contains the gudgeon pins are several arcuate segments of gear teeth that are urged inwardly against the mandrel by a resilient device such as a spring or springs. As the mandrel moves downwardly through the packer, the ratchetable teeth on the anchor cage slide over the band of teeth on the mandrel. The teeth are ratchetable in only one direction. As the mandrel moves downwardly with respect to the packer (which is being held in place by the friction pads) the teeth can ratchet with respect to each other. When the teeth are securely caught in locked engagement, the drill string is then pulled upwardly. A series of pivotable locking teeth in a lower slip assembly are forced outwardly against the well casing by a cam as the anchor cage moves upwardly. These teeth are angled so as to prevent the anchor cage from moving downwardly in the well casing, but does not prevent it from moving upwardly. As the mandrel continues to move the anchor cage upwardly, elastomer seals on the packer are compressed and a second cam on the upper side of the seals forces another set of locking teeth in an upper slip assembly outwardly into the well casing to prevent upward movement of the upper slip in which the upper teeth are mounted. Continued upward movement of the drill string compresses the entire unit because the upper slip assembly is now anchored by the locking teeth therein and will not move further upwardly. The lower teeth are engaged with the casing and will not allow the packer to move downwardly. The elastomer seals are compressed outwardly to engage the well casing and a fluid-tight seal is formed which prevents fluid below the packer from entering the well casing above the packer. Fluid in the well casing below the packer can be taken to the surface through the mandrel and the drill string.

When it is desired to remove the packer, the drill string has to be rotated in order to thread the latching teeth on the anchor cage off of the fixed teeth on the mandrel. Thus, it requires a considerable number of revolutions of the drill string to thread the anchor cage ratchetable teeth off the fixed mandrel teeth and, if the drill string should for any reason slip downwardly during the rotation, the ratchetable teeth simply slip over or ratchet across the fixed teeth on the mandrel and the process has to be started again.

The present invention overcomes the disadvantages of the prior art by providing a hydraulically operated well packer that automatically sets the packer in the well casing at the predetermined depth in the well casing when hydraulic pressure of a predetermined amount is supplied to the interior of the drill string. A mandrel is coupled to the end of the drill string and extends through the hollow well packer in a liquid sealing relationship. The packer includes upper and lower slip assemblies, each having pivotable teeth thereon for engaging the well casing when pivoted outwardly to lock the packer assembly in a fixed position in the well casing. At least one elastomer seal is positioned between the upper and lower slip assemblies. A hydraulic assembly is coupled to the upper and lower slip assemblies for compressing the at least one elastomer seal between the upper and lower slip assemblies to force the elastomer seal into a fluid sealing relationship with the well casing. Simultaneously, the hydraulic assembly forces the upper and lower slip assembly teeth into a gripping relationship with the well casing to rigidly set the packer in the casing.

A hydraulic piston is coupled to the lower slip for moving the lower slip along the mandrel toward the upper slip to compress the elastomer seals. Upper and lower cone assemblies are mounted respectively on the mandrel between the at least one elastomer seal and the slip teeth of the corresponding slip assemblies. Sloping surfaces on the upper and lower slip teeth engage a corresponding one of the cone assemblies as the lower slip is moved toward the upper slip which forces the lower teeth outwardly against the well casing and then forces the upper teeth outwardly against the well casing to rigidly set the packer.

The hydraulic piston assembly includes a first piston and a sleeve coupling the first piston to the lower slip assembly, with the first piston being selectively moveable from a first position to a second position to carry the lower slip assembly upwardly around the mandrel toward the upper slip assembly to compress the elastomer seals and force the upper and lower slip assembly teeth into gripping relationship with the well casing. The first piston is releasably locked in its first position and is enabled to move upwardly to its second position in response to a predetermined hydraulic pressure. A latch pin engages both the first piston and the mandrel to lock the first piston to the mandrel in its first position. A second piston is associated with the latch pin to hold the latch pin in engagement with the first piston and the mandrel. The second piston has a shear pin extending into a slot in the mandrel to lock the second piston to the mandrel. An orifice couples the interior of the mandrel to the first piston, the latch pin and the second piston and selectively provides hydraulic fluid under pressure to the first and second pistons and the latch pin. When sufficient hydraulic pressure is supplied to the orifice from the interior of the mandrel, the shear pin between the second piston and the mandrel breaks to enable the second piston to move away from and release the latch pin from engagement with the mandrel. The hydraulic pressure can then move the first piston in the upward direction to set the packer in the well casing.

An elongated arcuate section of teeth are integrally formed on opposing sides of the mandrel. Ratchetable arcuate segments of teeth are mounted on opposing sides of and carried by the cylindrical sleeve in radial alignment with corresponding ones of the mandrel arcuate teeth segments such that when the cylindrical sleeve moves upwardly carrying the lower slip assembly, the ratchetable teeth segments slip over and engage the teeth on corresponding ones of the elongated arcuate segments of teeth on the mandrel to lock the packer to the mandrel and prevent the cylindrical sleeve from slipping backwards. The arcuate segments of teeth on the mandrel and the cylindrical sleeve can be disengaged by rotating the mandrel no more than one-quarter turn because the arcuate sections of teeth on both the mandrel and the cylindrical sleeve are 60° arcuate segments. By rotating the mandrel no more than 90°, the two segments disengage from each other and allow the well packer to be released from its engagement with the well casing. Thus, there are no J-slots on the improved mandrel, the mandrel does not have to be moved to set the packer and there are no frictional shoes on the well packer to hold it in place while the packer is being set.

Thus, it is an object of the present invention to provide a hydraulically operated well packer.

It is also an object of the present invention to provide a hydraulically operated well packer that includes a piston associated with a mandrel which is latched to and carried by the mandrel until hydraulic pressure of a sufficient amount is applied to the piston which releases it from the mandrel and enables it to carry a lower slip housing towards an upper slip housing to compress elastomer seals positioned between the slip assemblies and which sets the teeth in the upper and lower slip assemblies into engagement with the well casing to set the packer.

BRIEF DESCRIPTION OF THE DRAWINGS

These and other objects of the present invention will be disclosed more fully in conjunction with the detailed description of the accompanying drawings in which like numerals represent like elements and in which.

DETAILED DESCRIPTION OF THE DRAWINGS

Figure 1:
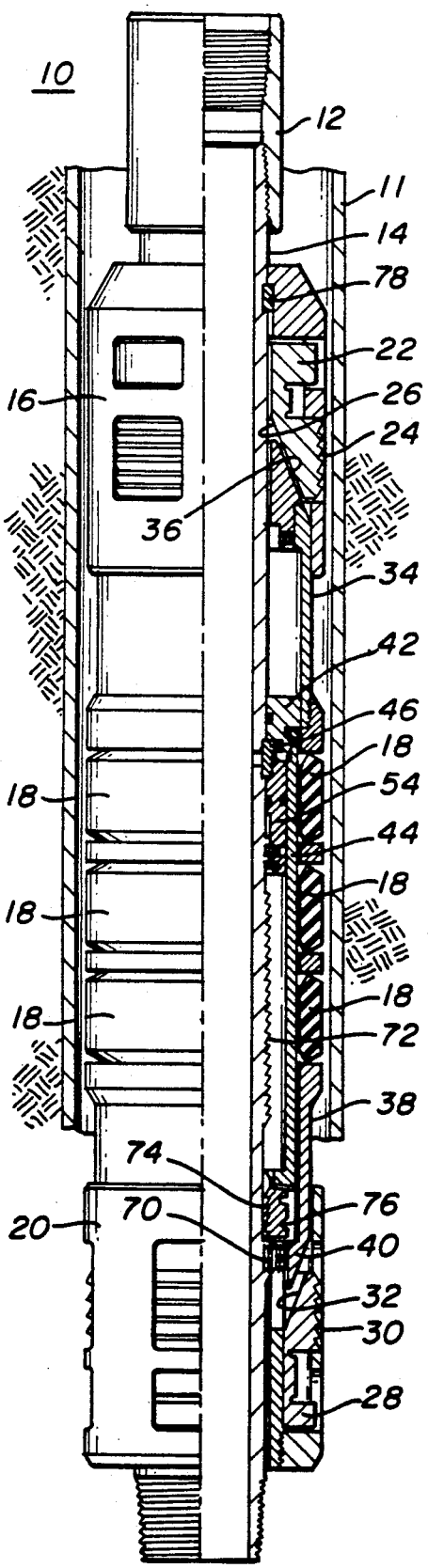
FIG. 1 is a partial cross-sectional view of the novel hydraulic well packer illustrating the interconnection between the elements of the packer and the piston assembly for setting the packer in a well casing.

FIG. 1 is a partial cross-sectional view of the novel hydraulic well packer assembly generally designated by the numeral 10. A drill string coupler 12 is threadedly coupled to the upper end of a mandrel 14. The mandrel is hollow so that fluids in the well can travel through the mandrel and the drill string to the surface. The well packer has three basic elements that include the upper slip assembly 16, the elastomer seals 18, and the lower slip assembly 20. The upper slip assembly 16 is preferably cylindrical in shape and has at least one pivotal tooth carrier 22 that has teeth 24 on one end thereof and a sloping surface 26 under the teeth 24. The lower slip assembly 20 is also cylindrical in shape and also has at least one pivotal tooth carrier 28 having teeth 30 thereon and a sloping inner surface 32. The teeth 24 on the upper slip assembly 16 are angled such that when they are pivoted outwardly to contact the well casing 11, they prevent the packer 10 from moving upwardly in the well casing 11. The teeth 30 of the lower slip assembly 20 are angled such that when pivoted outwardly they contact the well casing 11 at an angle to prevent the packer 10 from moving downwardly in the well casing 11.

A cylindrical upper head assembly 34 has a conical shaped nose 36 for engagement with the sloping surface 26 of the pivotable tooth carrier 22 in first upper slip assembly 16. A cylindrical lower head assembly 38 also has a conical portion 40 that engages the sloping surface 32 of pivotable tooth carrier 28. A first cylindrical piston assembly 42 is threadedly coupled to a cylindrical sleeve 44 that is threadedly coupled at the lower end thereof to the lower slip assembly 20 with threads 29. A latch pin 46, shown in detail in FIG. 2, prevents piston 42 from moving in relation to the mandrel 14.

Figure 2:
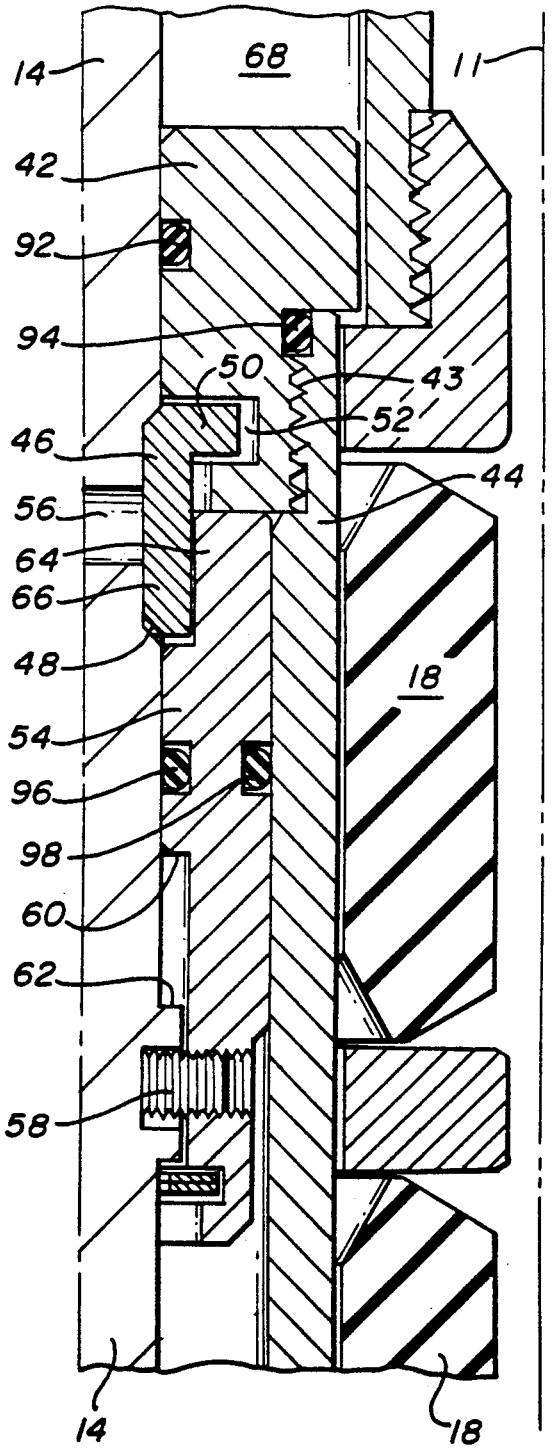
FIG. 2 is an enlarged version of the piston area of the novel hydraulic well packer illustrating the piston assembly in detail.

Referring now to FIG. 2, when sufficient hydraulic pressure is applied to the inside of mandrel 14, the pressure is coupled through orifice 56 in mandrel 14 to latch pin 46, first piston 42 and a second piston 54. The second piston 54 is held in rigid engagement with the mandrel 14 by a shear pin 58. When sufficient pressure is applied through orifice 56 to second piston 54, the shear pin 58, which is made of a metal such as brass that will shear under a predetermined load, is sheared off allowing the piston 54 to move downwardly until its shoulder 60 engages shoulder 62 on mandrel 14. That distance is sufficient to allow the upper portion 64 of the second piston 54 to clear the portion 66 of the latch pin 46. Because portion 50 of latch pin 46 can move further into slot 52 in piston 42, the latch pin 46 moves out of the slot 48 in mandrel 14, thus allowing piston 42 to move upwardly in the channel 68 between the upper head 34 and the mandrel 14. Because piston 42 is coupled to sleeve 44 with threads 43, as it moves upwardly, it carries with it cylindrical sleeve 44.

Referring again to FIG. 1, the upward force on first piston 42 severs shear pin 70, coupling sleeve 44 to mandrel 14 within lower slip assembly 20. Pin 70 holds the sleeve 44 in proper relation to mandrel 14 so that as the sleeve 44 moves upwardly as described, teeth 74 on sleeve 44 engage teeth 72 on mandrel 14. The entire sleeve assembly 44 now begins to move upwardly carrying with it the lower slip assembly 20. When the sloping surface 32 of pivotable tooth carrier 28 strikes sloping surface 40 of head 38, the teeth 30 are pivoted outwardly into engagement with the well casing 11. However, they are angled such that they can slip further upwardly in the well casing 11. Further movement upwardly of slip carrier 20 and head 38 forces the elastomer seals 18 against upper head 34 moving it upwardly. When the conical surface 36 of upper head 34 engages sloping surface 26 of the pivotable tooth carrier 22, it forces teeth 24 outwardly to engage the well casing 11. Because these teeth are angled upwardly, as they engage the well casing 11, they lock upper slip assembly 16 to the well casing 11 so that it cannot move further upwardly. Continued movement by the hydraulic piston 42 to carry lower slip assembly 20 upwardly compresses elastomer seals 18 and forces them outwardly into engagement with the well casing 11 to form a fluid tight seal.

Figure 3:
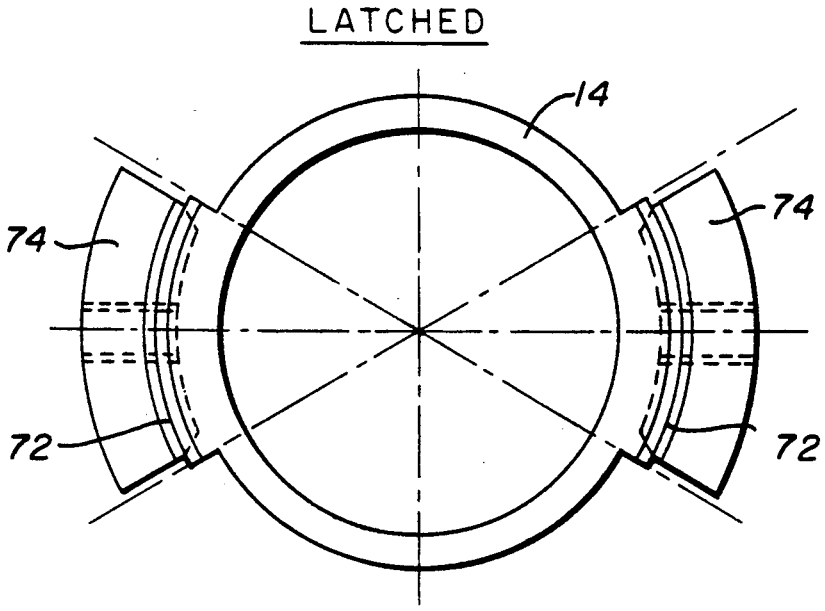
FIG. 3 is a cross-sectional view of the mandrel and the arcuate section of the mandrel teeth engaged with the arcuate section of teeth on the cylindrical sleeve that is part of the packer assembly.
Figure 4:
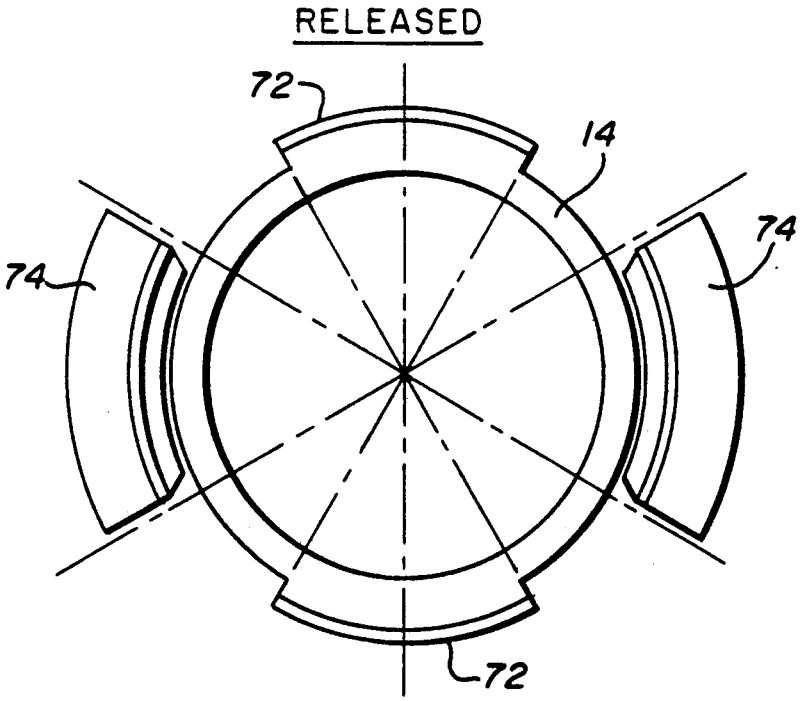
FIG. 4 is a cross-sectional view of the mandrel illustrating the arcuate section of teeth on the cylindrical sleeve of the packer released from the arcuate section of teeth formed on the mandrel.

Mandrel 14 has an arcuate segment of teeth 72 formed on opposing sides thereof as best illustrated in cross section in FIGS. 3 and 4. As can be seen in FIG. 1, the arcuate section of teeth 72 is elongated on the surface of the mandrel 14. The arcuate length of the segment of teeth 72 on mandrel 14 is approximately 60° as can best be seen in FIG. 4. In like manner, a corresponding segment of teeth 74 are mounted in slots on opposing sides of the sleeve 44. They are held against the surface of mandrel 14 by resilient means such as springs placed in slots 76. As the hydraulic piston 42 carries sleeve 44 upwardly, it also carries the ratchetable teeth 74 upwardly because they are in alignment with the arcuate segment of teeth 72 on mandrel 14. Because the teeth 74 are ratchetable, they slip over teeth 72 as long as the sleeve 44 is moving upwardly. The arcuate segments of teeth on both mandrel 14 and sleeve 44 are angled such that they can ratchet over each other when the sleeve 44 moves upwardly, but cannot move downwardly and thus engage each other in a latching fashion. The latch position of the arcuate segments is illustrated in FIG. 3. Thus, the hydraulic pressure on the inside of mandrel 14 will force piston 42 upwardly until slip assemblies 16 and 20 are locked in their engaged position with the well casing 11 with the elastomer seals 18 compressed and forming a liquid seal with the well casing 11. Because the teeth segments 72 and 74 are latched, the hydraulic pressure can be relieved and the assembly will maintain itself in locked position in the well casing 11. Clearly, sleeve 44 could be coupled to upper slip assembly 16 and piston 42 could be made to move downwardly in FIG. 1 thus moving upper slip assembly 16 toward lower slip assembly 20 to compress elastomer seals 18 and set the packer 10 in the well casing 11. Further, the two opposed 60° arcuate segments of teeth and the matching ratchetable segments of arcuate teeth could be replaced with one arcuate segment of fixed teeth having an arcuate length up to 180° and a corresponding ratchetable section of teeth having an arcuate length up to 180°. Then a rotation of less than one turn would disengage the teeth. The preferred embodiment, however, uses the opposed 60° segments. Other combinations such as four 30° arcuate sections spaced 90° apart would also function to achieve the desired results.

When it is desired to remove the well packer 10 from the well, the mandrel 14 is simply rotated 90° as illustrated in FIG. 4 which releases the latching engagement of teeth 72 with teeth 74. Thus, the mandrel is no longer locked to the well packer. By pulling upwardly on the drill string and mandrel 14, shoulder 78, shown in FIG. 1, engages the upper slip assembly 16 tending to move it upwardly a small amount of movement upwards allows the biased teeth 24 to move inwardly since a gap is introduced between the sloping surfaces 26 and 36. As the teeth 24 move inwardly, the upper slip assembly 16 can move upwardly. This continued upward movement allows the upper slip assembly 16 to be free of well casing 11 because the teeth 24 now move inwardly by a biased force such as a spring in a well-known manner. Continued upward movement then allows the middle shoulder elastomer seals 18 to decompress allowing lower head assembly 38 to move conical shoulder 40 away from conical shoulder 32 under teeth. 30, thus allowing teeth 30 to be moved inwardly by biasing means such as springs in a well-known manner. Thus, the entire packer assembly 10 is now free of the well casing 11 and can be moved out of the well casing 11. At the surface, shear pins can be replaced and the system reset for use in another well.

Figure 5:
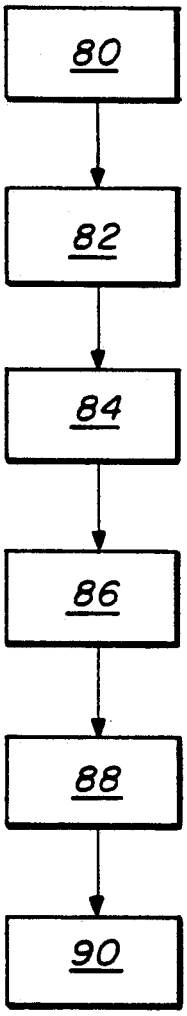
FIG. 5 is a block diagram of the novel steps for performing the present inventive process.

The novel steps of the present invention are illustrated in FIG. 5. At step 80, the packer is let down into the well to the proper location. At step 82, the mandrel is pressurized with a predetermined amount of hydraulic pressure. At step 84, the shear pins are severed and the pistons in the packer move to set the packer in the well and latch the mandrel to the packer. At step 86, the mandrel is rotated no more than one-quarter turn to release the teeth on the mandrel from the ratchetable teeth on the packer. At step 88, the mandrel is lifted upwardly to free the packer from the well casing and, at step 90, the packer is removed from the well. O-rings 92, 94, 96 and 98 provide fluid-tight seals preventing fluid from passing through the interior of the packer to the well casing 11 above the packer.

Thus there has been disclosed a novel well packer which enables a well packer to be set in a well simply by pressurizing the interior of the mandrel. With sufficient pressure, a piston is released from its connection to the mandrel and slides upwardly compressing the upper and lower slip assemblies with respect to each other, thereby compressing elastomer seals to form a liquid seal with the well casing. At the same time, it latches fixed teeth on the mandrel with ratchetable teeth on the packer to hold the assemblies together. The hydraulic pressure can then be removed from the mandrel interior. When it is desired to remove the packer, the mandrel is simply rotated one-quarter of a turn, because the arcuate sections of teeth on the mandrel and the packer are segments having an arcuate length of no more than 60°. Thus, they release from each other with less than a one-quarter turn of the mandrel. The mandrel can then be pulled upwardly releasing the packer from the well casing and removing it from the well.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A hydraulically operated hollow well packer assembly for insertion in a well casing including a mandrel coupled to a drill string and extending through the hollow well packer in a liquid sealing relationship, said packer assembly comprising:

upper and lower slip assemblies each having pivotable teeth thereon for engaging the well casing when pivoted outwardly to lock said packer assembly in a fixed position in said well casing;

at least one elastomer seal between said upper and lower slip assemblies;

hydraulic means coupled to said upper and lower slip assemblies for moving said assemblies together and compressing said elastomer seal between said upper and lower slip assemblies to force said elastomer seal into a fluid sealing relationship with said well casing, said hydraulic means forcing said upper and lower slip assembly teeth into a gripping relationship with said well casing to rigidly set said packer in said casing;

a hydraulic piston assembly coupled to said lower slip assembly for moving the lower slip assembly along the mandrel toward the upper slip assembly to compress the elastomer seal;

upper and lower cone assemblies respectively mounted on said mandrel between said elastomer seal and the pivotable teeth of a corresponding slip assembly;

sloping surfaces on said upper and lower pivotable teeth for engaging a corresponding one of said cone assemblies as said lower slip assembly is moved towards said upper slip assembly first to force the lower teeth outwardly against the well casing and second to force the upper teeth outwardly against the well casing to rigidly set the packer in the well casing;

said hydraulic piston assembly having a first piston;

a cylindrical sleeve coupling said first piston to said lower slip assembly;

said first piston being selectively moveable from a first position to a second position to carry said lower slip assembly upwardly about said mandrel toward said upper slip assembly to compress said elastomer seals and force said upper and lower slip assembly pivotable teeth into said gripping relationship with said well casing;

hydraulic pressure responsive means coupled to said first piston for releasably locking said first piston in said first position and enabling upward movement of said first piston to said second position in response only to said hydraulic pressure;

said hydraulic pressure responsive means having a latch pin engaging both said first piston and said mandrel to lock said first piston in said first position;

a second piston associated with said latch pin to hold said latch pin in engagement with said first piston and said mandrel to prevent movement of said first piston;

means releasably locking said second piston to said mandrel; and an orifice coupling the interior of said mandrel to said first piston, said latch pin and said second piston for providing hydraulic fluid to said first and second pistons and said latch pin.

2. A hydraulically operated well packer as in claim 1 wherein said second piston releasable locking means comprise:

a slot in said mandrel; and a shear pin extending from the second piston body to said slot in said mandrel to prevent said second piston from moving, said shear pin being severed between said second piston and said mandrel when sufficient hydraulic pressure from said coupling orifice is applied to said second piston so as to move said second piston away from and release said latch pin from engagement with said mandrel so as to enable said hydraulic pressure to move said first piston and set said packer in said well casing.

3. A hydraulically operated well packer as in claim 2 further comprising:

an elongated arcuate section of teeth integrally formed on opposing sides of said mandrel; and ratchetable arcuate segments of teeth mounted on opposing sides of and carried by said cylindrical sleeve in radial alignment with corresponding ones of said mandrel arcuate teeth segments such that when said cylindrical sleeve moves upwardly carrying said lower slip assembly, said ratchetable segments of teeth slip over and engage the teeth on corresponding ones of said elongated arcuate segments of teeth on said mandrel to lock said packer to said mandrel and prevent said cylindrical sleeve from slipping backwards.

4. A hydraulically operated well packer as in claim 3 further comprising means for disengaging said engaged arcuate segments of teeth on said cylindrical sleeve and said mandrel when said mandrel is rotated no more than one-quarter turn so as to enable the release of said packer from engagement with said well casing.

5. A hydraulically operated well packer as in claim 4 wherein said means for disengaging said engaged arcuate segments of teeth comprise:

an arcuate section of elongated teeth of approximately 60° formed on opposing sides of said mandrel; and an arcuate segment of teeth of approximately 60° mounted on opposing sides of said cylindrical sleeve in radial alignment with the teeth sections on said mandrel such that rotation of said mandrel by less than one turn disengages said teeth.

6. A method of setting a well packer in a well casing comprising the steps of:

forming said well packer with upper and lower slip assemblies having teeth therein for engaging the well casing to secure said packer in said well casing;

placing elastomer seals between said upper and lower slip assemblies for forming a liquid-tight seal with said well casing when compressed;

lowering a mandrel carried packer assembly into said well casing to the desired depth to set the packer;

pressurizing the interior of the mandrel carrying the well packer;

coupling the pressure from the interior of the mandrel to a piston assembly surrounding said mandrel;

coupling said piston assembly to said lower slip assembly such that said hydraulic pressure forces said lower piston assembly toward said upper slip assembly, said lower slip assembly being carried with said piston and compressing the elastomer seals and forcing the teeth in both the upper and lower slip assemblies outwardly in locking engagement with said well casing;

forming substantially 60° arcuate segments of teeth on opposing sides of said mandrel; and forming ratchetable substantially 60° arcuate segments of teeth as part of said sleeve assembly such that as said sleeve assembly is moved upwardly by said piston assembly, said ratchetable teeth engage said mandrel teeth to latch said mandrel to said packer assembly.

7. A method as in claim 6 further comprising the steps of:

rotating said mandrel less than one turn to unlatch said mandrel teeth from said ratchetable teeth; and moving said mandrel upwardly to release said packer from said well casing.

* * * * *